United States Patent [19]

Gillot et al.

[11] 4,213,680

[45] Jul. 22, 1980

[54] SETTING APPARATUS

[76] Inventors: Gary W. Gillot, 2, Sedgmoor Rd., Flackwell Heath; David H. Wright, 4, Horton Gardens, Horton, both of England

[21] Appl. No.: 960,279

[22] Filed: Nov. 13, 1978

[30] Foreign Application Priority Data

Nov. 16, 1977 [GB] United Kingdom ..... 47613/77

[51] Int. Cl.[2] ..... B41B 17/02

[52] U.S. Cl. ..... 354/12

[58] Field of Search ..... 354/5, 8, 9, 12–15, 354/17–19

[56] References Cited

U.S. PATENT DOCUMENTS

| | | | |
|---|---|---|---|
| 2,883,918 | 4/1959 | Mosteller | 354/17 |
| 2,887,024 | 5/1959 | Horman et al. | 354/17 |
| 2,890,634 | 6/1959 | Rondthaler et al. | 354/5 |

FOREIGN PATENT DOCUMENTS

| | | | |
|---|---|---|---|
| 1952980 | 4/1971 | Fed. Rep. of Germany | 354/13 |

*Primary Examiner*—John Gonzales

*Attorney, Agent, or Firm*—Jones, Tullar & Cooper

[57] ABSTRACT

An apparatus for visually setting type in which a carriage (11) has at least two parallel tracks (12) arranged thereon, a displaceable font carriage (13) adapted to co-operate with one track, carries a master font (14) on which are printed a series of negative characters and an identically arranged parallel series of positive characters, one of the tracks being adapted to receive a movable character bearing font (15) adapted to be displaced relative to the carriage (11) and to the master font (14), an exposure unit (17) being arranged above the carriage to photograph a selected character from the negative font on to a film strip (16) arranged therebelow.

5 Claims, 2 Drawing Figures

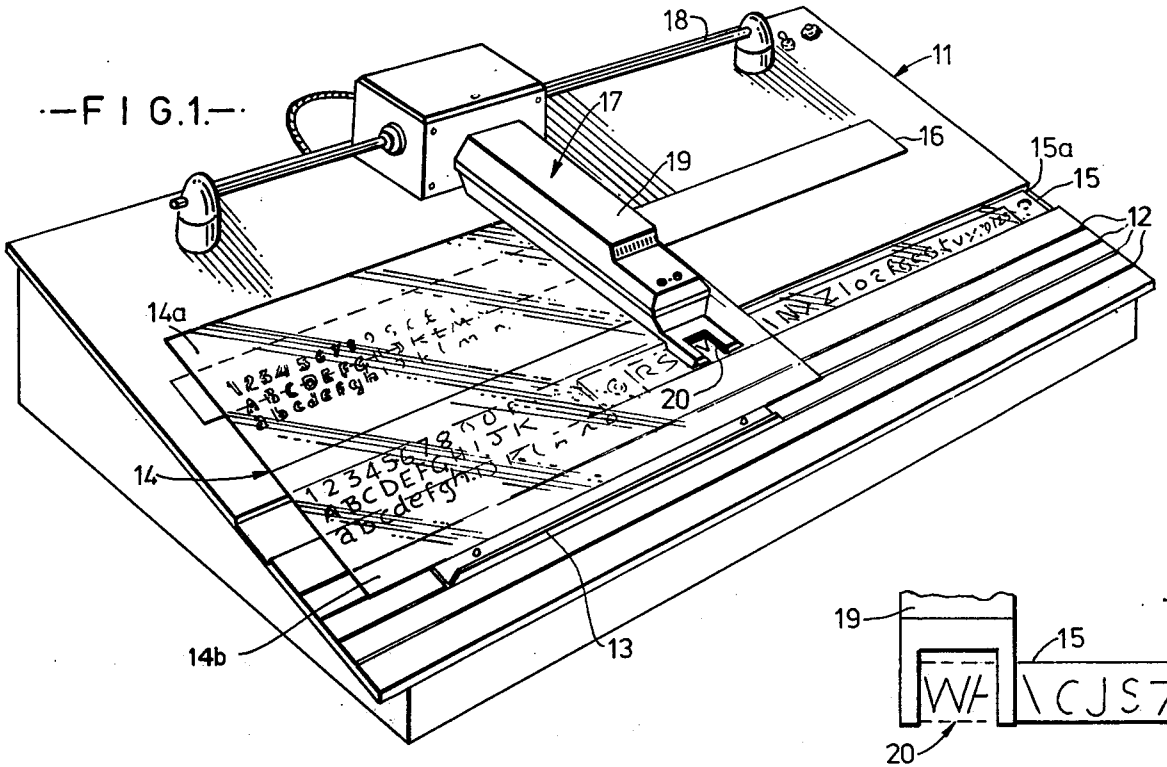
—FIG.1.—
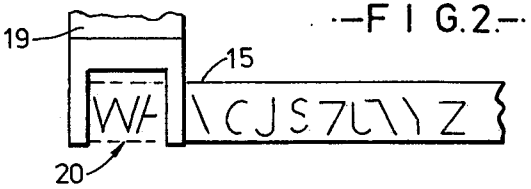
—FIG.2.—

SETTING APPARATUS

The present invention concerns visual setting apparatus, more especially visual setting apparatus for use in photographically setting series of characters such as letters or numerals.

Apparatus for setting a series of characters by "visual spacing" are known. These characters occupy varying areas dependent upon the width of the character. Thus a wide character such as the letter "W" will occupy a relatively wide area, whereas a narrow character such as letter "I" will only occupy a narrow area. The characters are then located immediately adjacent one another.

This form of spacing is pleasing to the eye since the size of spaces between letters is reduced, but it will be apparent that in the case of adjacent letters with angularly disposed parts, e.g. that letter "W" and the letter "A" a larger space will appear between the letters which is not entirely desirable.

Another form of setting which is sometimes utilised at the present time for setting items such as, for example, newspaper head lines, utilises socalled "visual spacing" in which the various characters are spaced having due regard for the adjacent characters on either side thereof, the characters again occupying varying areas, as described above. Thus, for example, in setting the word "WATER" the "W" and the "A" would be located very close together with the upper part of the right hand arm of the "W" actually extending above the lower part of the left hand arm of the "A".

As described above, at the present time the only way of effecting "visual setting" is for an operator to position characters by eye, the set characters normally being reproduced by a photographic process.

In one prior proposed method of visually setting type a photographic process is utilised in which various characters are recorded sequentially on a strip of photographic film subsequently being developed to present the characters in a set form. In such a process it is necessary to advance the characters (or images thereof) relative to the photographic film, or to advance the film relative to the characters, and thus it is difficult to position characters accurately. Various attempts have been made to overcome this problem by utilising a fluorescent medium or some other temporary medium for recording the position of character, but such methods suffer from the drawback that the image recorded on the fluorescent medium fades away in a short period of time, and thus the characters must be set at high speed.

Prior apparatus for "visual spacing" are costly to produce and require skilled personnel for their operation.

An object of the present invention is to provide an inexpensive apparatus which has relatively few moving parts and which can be operated with certainty even by a semi-skilled worker.

According to the present invention a setting apparatus comprises a carriage having at least two parallel tracks arranged thereon, a displaceable font carriage, adapted to co-operate with one track, carrying a master font on which are printed a series of negative characters and an identically arranged parallel series of positive characters, one of the tracks being adapted to receive a movable character bearing font adapted to be displaced relative to the carriage and to the master font, an exposure unit being arranged above the carriage to photograph a selected character from the negative font on to a film strip arranged therebelow. Preferably the negative characters are arranged on an opaque background whilst the positive characters are arranged on a transparent background.

It has been found that when a character on the movable character bearing font is being visually spaced from the trailing edge of the preceding character, only the leading edge is required to be seen. It is therefore possible to provide split image profiles only. This reduces the number of characters needed on the movable font; for example of the twenty-six capital letters of the alphabet there are only ten different leading edge profiles. Similarly the number of lower case leading edge profiles can be reduced and likewise the number 0 to 9.

In one embodiment of the invention the carriage is rectangular and provided with plurality of parallel tracks so that the font carriage is adapted to cooperate selectively with any one track. In this case the master font has a plurality of tracks comprising a series of negative characters and are identically arranged parallel series of positive characters.

In another embodiment of the invention it is envisaged to provide a single line of negative characters and an identically arranged parallel series of positive characters. These could be mounted on a flat bed, or a drum shaped carriage and the movable character bearing font arranged below the positive characters in a parallel track.

It is possible to provide a fixed light source and advance the film strip. When using standard exposure film it is then desirable to provide a red screen over the negative font and film. However it is also possible to use BRITE LITE (Registered Trade Mark of DUPONT) film where no special safe lights are required, as it is not very sensitive to tungsten room lighting. In the case of BRITE LITE film, this can be simply attached to the carriage under the negative font by any suitable means such as Sellotape (R.T.M.) or magnetic clips and a movable light source can be provided. The split image profile font can be movable on its own or in conjunction with a film carriage unit.

The invention will now be described further, by way of example, with reference to the accompanying drawings, in which:

FIG. 1 is a perspective view of an apparatus constructed in accordance with the invention having a flat bed carriage and movable light source; and FIG. 2 is a detail of the viewing window showing one full character and a positioning profile from the movable font therebelow.

A substantially rectangular carriage 11 is provided with four grooved parallel tracks 12 on which can be displaced a font carriage 13 having a depending linear projection (not shown) adapted to co-operate with a selected track 12. The font carriage 13 carries a multi-track master font 14 on which are printed a series of negative characters, on an opaque background, in an upper part 14*a* and an identically arranged series of positive characters, on a transparent background, in a lower part 14*b*. A split image profile font 15 is movable below the master font 14; the characters on the font 15 are all the different leading profiles of the capital and lower case letters of the alphabet as well as the leading profiles of the numbers 0 to 9 (a few only being shown in FIG. 2). The font 15 is moved in a groove 15*a*, remaining in position merely by friction after positioning. Alternatively, locking means (not shown) can be used.

A film strip 16 of the BRITE LITE (R.T.M.) type is arranged in the upper portion of the carriage 11 underneath the negative character font 14*a*. A movable exposure unit 17 is mounted on a carrier 18 so as to be movable parallel to the characters on all the fonts. The exposure unit 17 has an exposure aperture (not shown) on the underside of its arm 19. A viewing window 20 is arranged at the front end of the arm 19 so that the positive characters and the split image profiles can be viewed therein.

To make up a word, a series of letters or numbers, the downward projection of the font carriage 13 is arranged in the selected track 12 so that the first chosen positive character appears in the viewing window 20 (FIG. 2). The exposure unit is now activated and the character is photographed on to the film 16. The position the succeeding character visually, the movable split image profile carrying font 15 is moved below the positive characters on the font 14*b* so that the second character profile lies adjacent the trailing edge of the character already photographed and visually correctly positioned; the font carriage 13 is then moved so that the second character on the positive screen is in register with the split image character. The negative of the second character is then correctly positioned below the exposure unit aperture with respect to the preceding exposed character and can then be photographed.

It can be seen that the apparatus described provides a simple way in which visual setting can be achieved for a series of characters, words or numbers.

We claim:

1. An apparatus for visually setting type in which characters are recorded sequentially on film by a photographic device arranged thereabove, comprising a carriage, a film-strip mounted on said carriage, at least two parallel tracks arranged on said carriage, a displaceable font carriage provided with means for co-operating with one said track, said font carriage carrying a master font on which are printed a series of negative characters and an identically arranged parallel series of positive characters, a movable character bearing font, displaceable relative to said carriage and to said master font, being movable on a second said track and an exposure unit arranged above said carriage to photograph a selected character from said negative font on to said film-strip arranged therebelow.

2. An apparatus according to claim 1, wherein said negative characters are printed on an opaque background carrier and said positive characters are printed on a transparent background carrier.

3. An apparatus according to claim 1, wherein said movable character bearing font has split image profiles.

4. An apparatus according to claim 1, wherein said carriage is rectangular and comprises a plurality of tracks.

5. An apparatus according to claim 1, wherein said exposure unit is movable and said film-strip is stationary.

* * * * *